United States Patent [19]

Wieck

[11] 4,024,672

[45] May 24, 1977

[54] APPARATUS FOR THE MICRO-FINISH OF CYLINDRICAL OR CONICAL SURFACES

[75] Inventor: Karl Wieck, Stuttgart, Germany

[73] Assignee: Supfina Maschinenfabrik Hentzen KG, Remscheid, Germany

[22] Filed: Mar. 17, 1975

[21] Appl. No.: 558,956

[30] Foreign Application Priority Data

Mar. 18, 1974 Germany ..... 2413000

[52] U.S. Cl. ..... 51/57; 51/67

[51] Int. Cl.[2] ..... B24B 19/06

[58] Field of Search ..... 51/57, 67, 229, 219 PL, 51/289, 34 R, 34 D, 34 C

[56] References Cited

UNITED STATES PATENTS

| | | | |
|---|---|---|---|
| 2,195,066 | 3/1940 | Wallace | 51/67 |
| 2,573,368 | 10/1951 | Seborg | 51/34 D |
| 2,752,740 | 7/1956 | Mouw | 51/225 X |
| 3,451,175 | 6/1969 | Sunnen | 51/34 R X |
| 3,490,179 | 1/1970 | Militzer | 51/67 |

*Primary Examiner*—Harold D. Whitehead
*Attorney, Agent, or Firm*—Edwin E. Greigg

[57] ABSTRACT

Method and apparatus for micro-finish machining of cylindrical or conical surfaces on workpieces, and in particular the raceways of cylindrical or tapered roller bearings using a honing tool. The honing tool is subjected to two distinct motions in a direction parallel to the transverse direction of the surface of the raceway to be machined. One of the motions, the first oscillation, has a short stroke relative to the width of the surface to be machined, while the other motion extends over the entire width of the surface to be machined. The two motions are superimposed for achieving a surface contour of the raceway so that during full loading of the bearing, the raceway is subjected to approximately uniform surface pressure over the entire width of the raceway.

5 Claims, 7 Drawing Figures

APPARATUS FOR THE MICRO-FINISH OF CYLINDRICAL OR CONICAL SURFACES

BACKGROUND OF THE INVENTION

The present invention relates to a method and apparatus for the fine or micro-finish machining of cylindrical or conical surfaces on workpieces, especially on the inner and outer races of roller bearings or tapered thrust bearings. The invention involves rotating the workpiece and providing a honing tool which acts on the surface of the workpiece by executing a swinging or oscillating motion (first swinging motion) in a plane parallel to the surface of the workpiece.

This type of micro-finish machining (super finishing, honing) performed on the races of cylindrical roller bearings or tapered thrust bearings improves the surface previously obtained by, for example, grinding, and also compensates for errors in roundness, especially short range errors.

The known state-of-the-art possesses certain disadvantages which shall now be explained with the aid of FIG. 1. In FIG. 1 there is shown the inner race 3 of a cylindrical roller bearing, whose track or raceway 2 is to be treated. The oscillating motion of the honing tool acting on this raceway 2 is limited by the two shoulders 2′ and 2″. These two shoulders 2′ and 2″ do not permit exceeding the width of the side ends of the raceway. The width of the honing tool used is approximately equal to the width D of the raceway 2 minus the amplitude of the oscillation of the honing tool without considering a small clearance for safety's sake. After the treatment described above, the raceway, which began as a flat surface 2, i.e., a straight ground generatrix line, has usually a somewhat concave appearance as shown in FIG. 1 by the dashed line A, i.e., a concave appearance to the generatrix line. This is due to the fact that during its oscillation, the honing tool acts on the middle region of the raceway 2 somewhat longer than on the outer regions. However, surfaces generated by a generatrix line of this type are not desirable as they cause very high pressures of the roller bearing rolling element at those places of the raceway which are critical anyway.

There is therefore a need for a method and an apparatus which make possible the machining of such surfaces without causing the formation of the slightly concave generatrix line as shown by the dashed line A. in FIG. 1. It might even be desirable to let the generatrix line have the appearance of a slightly convex form as is shown by the dashed line C in FIG. 1 so that during full loading of the bearing, the raceway 2 will be subjected to approximately uniform surface pressure over the entire width of the raceway. A surface generated by this type of generatrix line tends to diminish load peaks which would occur at the two sides of the raceway if the raceway were entirely straight. Therefore, it would be desirable to have a method and apparatus according to which the raceway is machined so that when viewed in transverse cross section the bottom surface of the raceway is preferably slightly convex as shown by the dashed line C.

OBJECTS AND SUMMARY OF THE INVENTION

It is, therefore, an object of the present invention to provide a method for micro-finish machining of workpieces.

It is another object of the present invention to provide an apparatus for micro-finish machining of workpieces and in particular bearing raceways so that during full loading of the bearing, the raceway is subjected to approximately uniform surface pressure over the entire width of the raceway.

It is a related object of the present invention to micro-finish machine a bearing raceway so as to eliminate the concave shape, when viewed in transverse cross section, of the bottom surface of the raceway.

These and other objects are achieved, according to the present invention, by providing a first oscillatory sideways motion of the working tool which has a short stroke by comparison with the width of the surface to be machined and to superimpose thereon a second motion of the working tool parallel to the surface to be machined and extending over the entire width of the surface to be machined. The second motion which is superimposed on the first oscillatory motion already mentioned, can be performed so as to adjust the working times of the working tool (honing tool) on the surface to be machined in such a manner that the amount of material removed can be controlled as a function of the width of the surface. In particular, it can be so adjusted that the amount of material removed will be larger in the outer regions of the surface being machined because, due to the manner of the second superimposed long-stroke motion, the dwell times of the working tool swinging with short strokes will be greater so that straight, and in particular convex surfaces may be obtained, i.e., convex when viewed in transverse cross section.

The invention will be better understood, and further objects and advantages will become more apparent from the ensuing detailed specification of three exemplary embodiments taken in conjunction with the drawing.

DESCRIPTION OF THE PREFERRED EMBODIMENTS

Figure 2:
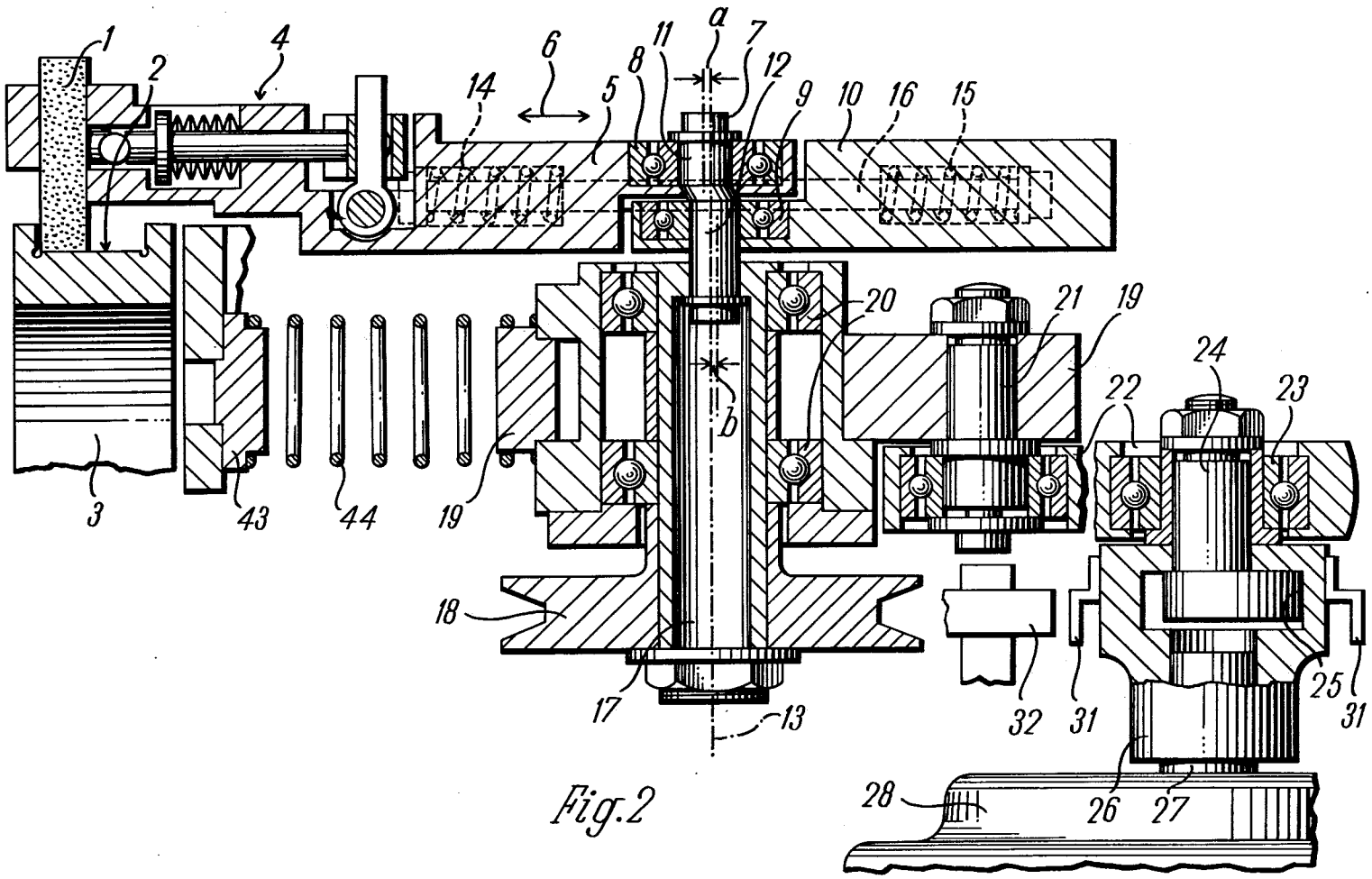
FIG. 2 illustrates a first exemplary embodiment of the apparatus according to the present invention.

Turning now to FIG. 2, in the first exemplary embodiment shown therein, the honing tool 1 serves for machining the raceway 2 of a roller bearing inner race 3. The honing tool 1, which is power-driven in rotation about its own axis by means not shown, stands on the raceway 2 and is held by a clamping mechanism 4 which can be constructed in a known manner. The clamping mechanism 4 permits an adjustment of the honing tool 1 when wear occurs. The clamping mechanism 4 is disposed on a first slide 5 which may be slidably moved within a first guide mechanism (not shown)

in the direction of the arrow 6. The first guide mechanism is locally fixed. A doubly eccentric shaft 7 is carried in a bearing 8 of the slide 5. The shaft 7 is further carried within a second bearing 9 in a second slide 10. The two eccentric sections are labeled 11 and 12. The eccentric section 11 is displaced by the indicated amount *a* with respect to the axis of rotation 13 and the eccentric section 12 is displaced by the indicated amount *b* with respect to the axis of rotation 13. Furthermore, both sections are displaced with respect to one another by 180°, so that, when the shaft 7 rotates, it causes an opposing motion of the two slides 5 and 10. This is done to equalize the effects of the oscillations of each of the slides on the entire apparatus; the slide 10 therefore performs the function of a counterweight. The two slides 5 and 10 are pushed toward the rotational axis 13 by springs 14 and 15, respectively, which are supported at their one end on the slides 5 and 10, respectively, and at their other ends at one end of an anchor piece 16 so as to eliminate any play of the shaft 7 in its bearings 8 and 9. The shaft 7 is mounted on a further shaft 17, driven via a belt pulley 18.

The apparatus described up to now which is known per se, serves to impart to the honing tool 1 an oscillatory motion (first oscillation) in the direction of the arrow 6, i.e., parallel to the transverse direction of the raceway 2. This first oscillation has a relatively high frequency (approximately 1500 oscillations per minute) and a relatively short stroke (approximately ±0.5 to ± lmm).

The entire apparatus is mounted on a further slide 19 which is also slidable in the direction of the arrow 6 within a second, locally fixed guide mechanism (not shown). The shaft 17 is mounted rotatably in bearings 20 within the slide 19. The slide 19 slides against the action of a spring 44 which is mounted as shown between the slide 19 and a stop member 43. The slide 19 (on the right side of FIG. 2) also contains a crank pin 21 engaged by a connecting rod 22. The other end of the connecting rod 22 contains a bearing 23 within which is mounted an eccentric 24. The eccentric 24 is adjustably located in a recess 25 within a drive member 26 which is driven via a shaft 27 by a motor 33, located within the motor housing 28. In a known manner, the adjustment of the eccentric 24 serves to set the radius of the circular motion which the right end of the connecting rod 22, as seen in FIG. 2, executes when the shaft 27 is driven.

In this manner, the slide 19 and hence the honing tool 1, is given a second oscillatory motion (second oscillation). It also occurs in the direction of the arrow 6, but at a relatively low frequency (approximately 150 cycles per minute), and with a relatively large stroke (up to 10mm). The stroke is adjusted by setting the eccentricity of the eccentric 24 between the values 0 and a maximum value.

Figure 3:
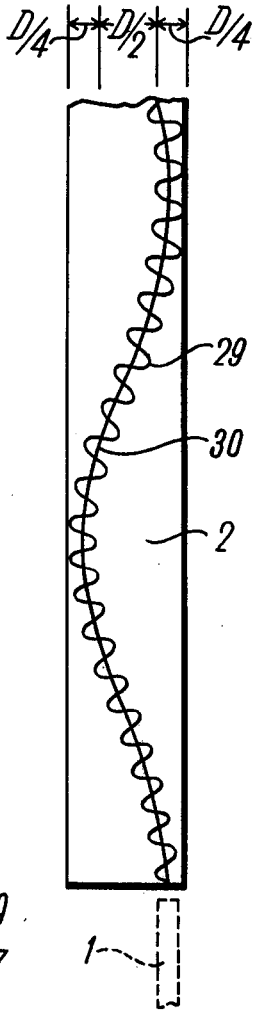
FIG. 3 is a schematic representation of the development of the motion of a honing tool.

When the development of the raceway 2 in a plane is considered as shown in FIG. 3, and if the path of a point on the honing tool 1 is followed, one obtains the path 29 of that point as a superposition of the short-stroke first oscillation and the long-stroke second oscillation. The path which would be followed by this second oscillation alone is designated with the numeral 30.

Figure 1:
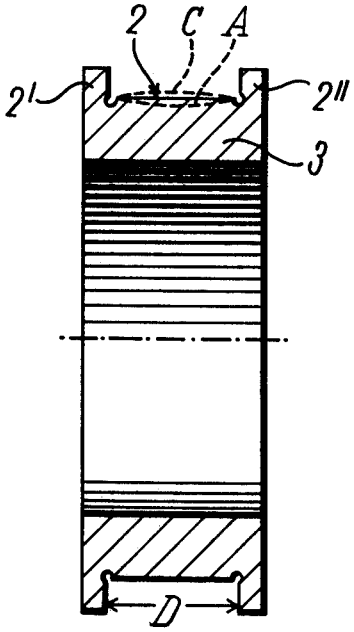
FIG. 1 illustrates a schematic side view of an inner race of a roller bearing.

It may further be seen from FIG. 3 that the honing tool 1 treats the outer regions of the raceway 2 during a longer period of time than the inner region. If the development of the second, low frequency and relatively long-stroke oscillation (path 30) — as in FIG. 2 — has a sinusoidal shape and if the time is compared during which the honing tool 1 resides in the two outer regions of the raceway 2, each of width D/4 (D is the width of the raceway 2) with that time which it spends in the median region which has the width D/2, then it is found that the dwell time in the two outer regions is twice as high as that in the inner region. As a result, the two outer regions are treated longer and hence a greater amount of material is removed in those regions. One therefore obtains a slightly bulging or convex outer surface contour of the raceway 2 as is shown in FIG. 1 by the dashed curve C.

It will now be described how the dwell time of the honing tool 1 in the outer sections of the raceway may be controlled. (It is noted in this connection that the term "dwell time" for a particular section or particular location means that during this time, the honing tool is located in this section or in this location insofar as its position is determined by the path 30.) The short-stroke, high-frequency first oscillation occurs even during this dwell time.

The rotating drive member 26 is provided with two tabs 31, displaced by 180° with respect to one another. One place along the circumference of the circle on which these tabs 31 move, contains a sensor 32 which operates without contact and which provides a signal when one of the tabs 31 passes it.

Figure 4:
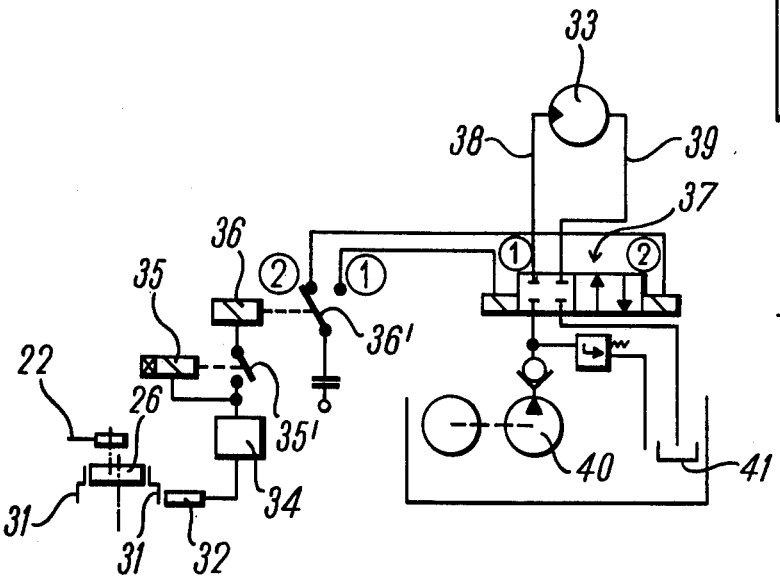
FIG. 4 is a circuit diagram for the first exemplary embodiment illustrated in FIG. 2.

As may be seen in FIG. 4, the sensor 32 serves for controlling the motor 33 which drives the shaft 27. Preferably the motor 33 is embodied as a hydraulic motor. When a tab 31 passes the sensor 32, a contact closes and the resulting signal is fed to an amplifier 34. This starts a timing relay 35. This timing relay is so constructed that its closed position is retained for a certain adjustable length of time after which it opens again. During this time, the working contact 35' of the timing relay 35 is closed. As a result, a further relay 36 is energized and a contact 36' is brought into the position designated ①. As a result, a magnetic valve, embodied as a 4/2-way valve 37 is also brought into its position ①. Thus, both a supply line 38 as well as a return line 39 which lead to and from the motor 33, are closed off. In this exemplary embodiment, the motor 33 is a sol-called "braking motor", i.e., a motor which immediately stops turning when its supply and return lines are closed.

After the preset time has elapsed, the timing relay 35 switches back to its normal condition, the working contact 35' reopens, the relay 36 is de-energized and the contact 36' returns to its position 2 in which the 4/2 -way valve 37 reassumes its position ② wherein the supply line 38 is again supplied with a pressurized hydraulic medium by a pump 40 and the return line 39 opens into a drain 41.

This has the following result: If the sensor 32 is so located on the circular path on which the tabs 31 move during a rotation of the drive member 26, that the tabs 31 always pass it when the second long stroke oscillation of the honing tool 1 has reached its maximum amplitude and the honing tool 1 attaches to a rim or edge section of the raceway 2, then, for a duration which may be determined by setting the arrest time of the timing relay 35, the motor is stopped. Thus, the duration of the treatment of the outer edge sections of the raceway 2 is adjustable. Since the arrest always occurs when the stroke has its highest amplitude, which, furthermore, is equal to the preset amplitude of the second oscillation, there is no abrupt change of the path of motion of the honing tool 1 on the surface of the raceway 2 in spite of the abrupt stopping and restarting thereof.

The apparatus so far described arrests the motor 33 after each half revolution of the drive member 26. Further known timing elements (not shown) could be provided in the circuit of FIG. 4 which would effect a controlled delayed starting of the motor 33. In this manner, the duration of the treatment of individual regions of the raceway 2, defined by points along the path 30, could be controlled at times other than the arrest times and at the outermost edge, in deviation from the sinusoidal development of the second oscillation as shown in the exemplary embodiment of FIG. 2, so that the treatment duration for the center of the raceway, i.e., its degree of overlap would be minimized in this manner.

Figure 5:
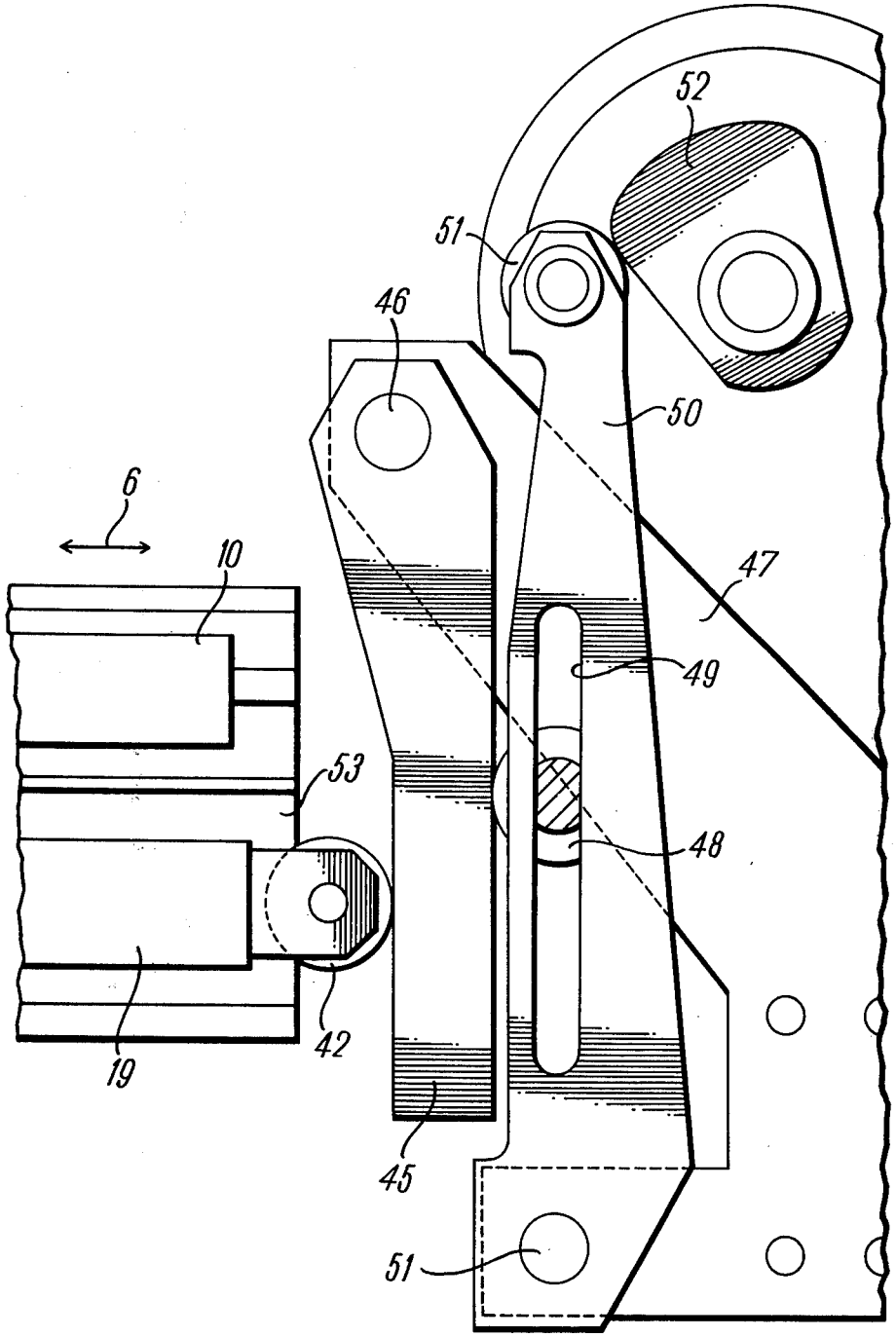
FIG. 5 illustrates a second exemplary embodiment according to the present invention.

FIG. 5 illustrates a second exemplary embodiment of the present invention, for which identical elements have the same reference numerals. The right side of the slide 19, as seen in FIG. 5, has disposed in it a roller 42. A spring 44, supported on a locally fixed stop member 43, (compare FIG. 2) pushes this roller 42 against a lever 45 which is pivotally mounted in a locally fixed carrier member 47 at a location 46. The lever 45, in turn, pushes against a roller 48 which is mounted rotatably at a location 51 within a slot 49 of a further lever 50. The lever 50 has a roller 52 mounted at its upper end as seen in FIG. 5. This roller presses on the circumference of a cam 53 driven by a slow running motor (not shown), (possibly motor 33 of FIG. 4). Depending on the position of the cam 53, the slide 19 is slidably moved in the direction of the arrow 6 (FIG. 5 shows the guidance mechanism for the slide 19, designated as 54). An adjustment of the position of the roller 48 within the slot 49 serves for the adjustment of the stroke of the second oscillation actuated by this mechanism for the slide 19, designated as 54). An adjustment of the position of the roller 48 within the slot 49 serves for the adjustment of the stroke of the second oscillation actuated by this mechanism. The farther down the roller is moved within the slot 49, the smaller is the stroke. The cam 53 can be so designed that two opposite portions of its circumferential surface form concentric arcs of circles (of different radius) whereas the sides are so made that they result in an approximately sinusoidal behavior of the velocity of motion of the honing tool 1. The angle enclosed by the circular arc regions of the cam 53 determines the arrest times of the honing tool 1 at the ends of the stroke, i.e., the dwell times at the edges of the raceway 2.

Figure 6:
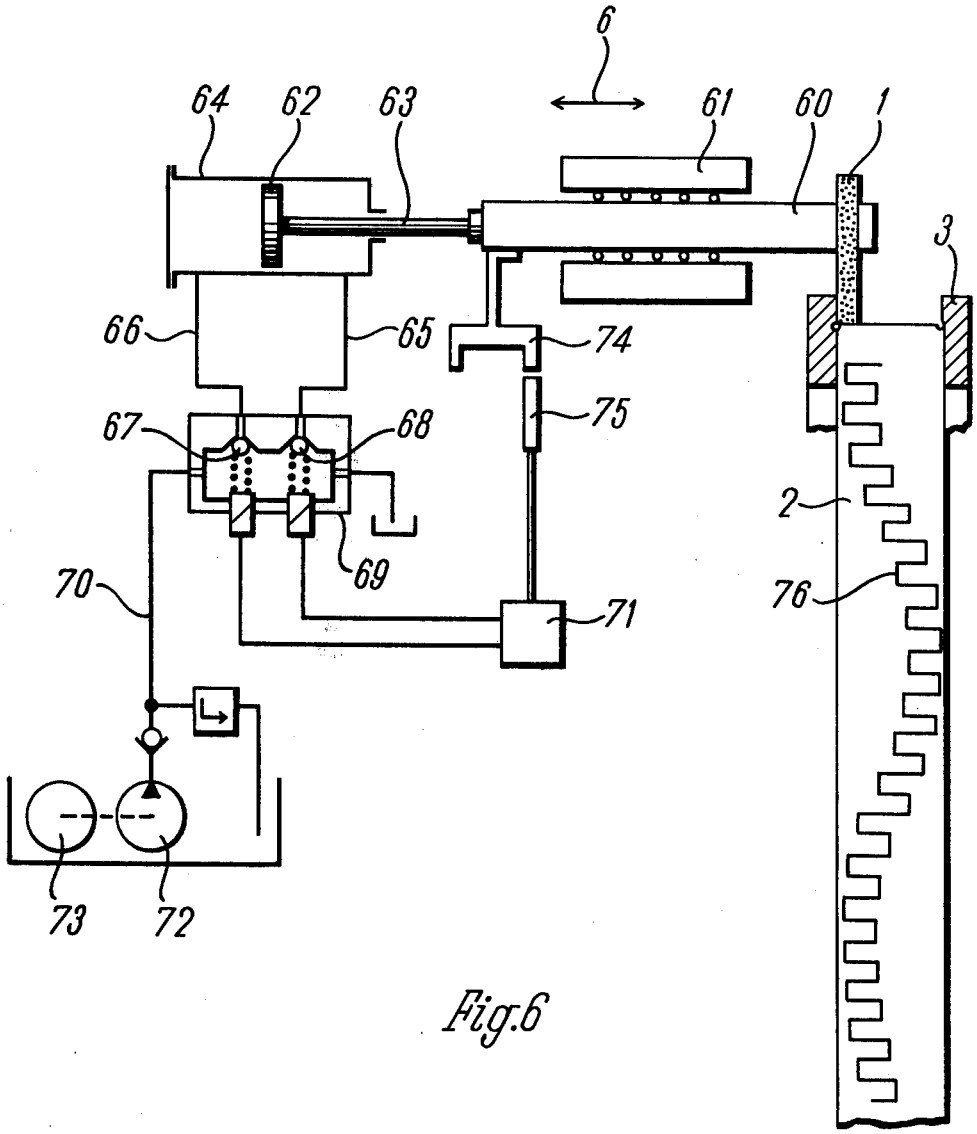
FIG. 6 illustrates a third exemplary embodiment according to the present invention.

A further exemplary embodiment is shown schematically in FIG. 6. One end of the honing tool 1 lies in a slide 60, slidably mounted in a guide mechanism 61 and movable in the direction of the arrow 6. The sliding motion takes place by means of a piston 62, connected with the slide 60 via a connecting rod 63. The piston 62 and connecting rod 63 slide within a cylinder 64. The two ends of the cylinder 64 are charged with a pressurized hydraulic medium through lines 65 and 66 respectively. The two lines 65 and 66 are connected to the outlets of two magnetic valves 67 and 68, both located in a block 69. These are known valves and they are so made and connected that, when the outlet of one of the two valves permits passage of the medium admitted through the line 70 to one side of the piston 62 in the cylinder 64, then the medium may drain off from the other side of the piston 62 and vice versa.

The magnetic valves 67 and 68 are controlled by a control unit 71 which consists substantially of timing elements which permit a controlled adjustment of the valve switching times, i.e., the time period of admission of medium or inflow time; and the time period of drainage of the medium or outflow time (drainage time). The construction of such a circuit is easily possible for any individual skilled in the art on the basis of the data provided, so that a further description can be dispensed with in this connection. The hydraulic medium is supplied by a pump 72 driven by a motor 73.

If the switching times of the two magnetic valves 67 and 68 are for example so adjusted that the inflow time ($T_{LZ}$) to the left side of the piston 62 and hence also the draingage time ($T_{RA}$) from the right side of the piston 62 ($T_{LZ} = T_{RA}$) is somewhat greater than the subsequent inflow time ($T_{RZ}$) to the right side of the piston 62 and hence also the drainage time ($T_{LA}$) from the left side of the piston 62 ($T_{RZ} = T_{LA}$), then the net result is that the piston 62, and hence also the honing tool 1, will execute a basic short-stroke oscillator motion whose period is equal to $T_{LZ} + T_{RZ}$, i.e., the time taken to complete two valve switching processes. Superimposed thereon will be a second, slower motion, in the direction of the arrow 6. The speed of the second motion depends on the difference between the inflow and drainage times to the right and to the left, respectively which are set for the two magnetic valves 67 and 68 by the control unit 71.

The reversal of the direction of the superimposed longitudinal motion of the honing tool 1 along the raceway 2 is occasioned by a position indicator 74 fastened to the slide 60. In its terminal positions it moves past a sensor 75 which provides a signal for the switching unit 71, which thereupon causes a suitable change of the switching times of magnetic valves 67 and 68. If this reversal of the motion at the terminal positions is included in the picture, then the superimposed longitudinal motion also represents a low-frequency, long-stroke, second oscillatory motion when compared to the first motion, albeit no longer a sinusoidal motion. The result is the path 76 described by a point of the honing tool 1 on the raceway 2 of the inner race 3, as shown on the right side of FIG. 6.

In the terminal positions of the honing tool 1, the control unit 71 does not cause a reversal of the motion of the slow, second oscillatory motion immediately, but only after the expiration of an adjustable length of time during which the switching times of both magnetic valves 67 and 68 are equal so that, in these terminal positions, an arbitrarily adjustable dwell time is given.

Figure 7:
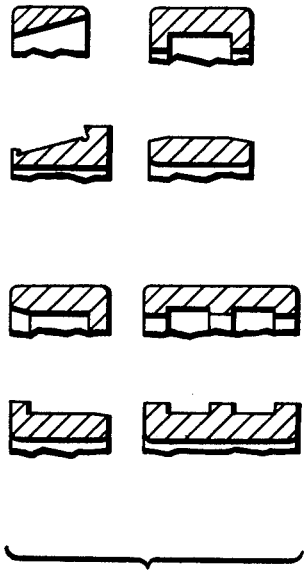
FIG. 7 illustrates different shapes of bearing races which may be machined according to the apparatus and method of the present invention.

In the foregoing, the invention has been described in its application to the machining of the raceway 2 of an inner race 3 of a roller bearing. It may also be used, however, when machining other cylindrical and even conical surfaces, such as may occur in the inner or outer races of bearings of the most widely different types. In FIG. 7 there is illustrated the cross sections of eight per se known races for various different bearings. The surfaces which may be machined by a method according to the present invention are in each case marked with an arrow.

What is claimed is:

1. In an apparatus for micro-finish machining of cylindrical or conical surfaces, of total length (D), on rotating workpieces, and in particular for the raceways of cylindrical or tapered roller bearings including a honing tool, the improvement comprising:

a. a first slide means engaging the honing tool;
b. means mounting the first slide means relative to the workpiece so that it and the honing tool will experience a first oscillation relative to the surface to be machined, whereby the stroke of said first oscillation is determined such that it is short as compared with the total length of the surface to be machined;
c. second slide means to which the means mounting the first slide means is mounted; and
d. drive means connected to the second slide means for driving the two slide means, the means mounting the first slide means and the honing tool so that the first slide means and the honing tool experience a second oscillation relative to the surface to be machined, whereby the stroke of said second oscillation is determined such that the path of the tool as determined by said second oscillation, essentially extends over the total length to be machined; wherein the drive means comprises:
   i. a drive motor;
   ii. a rotating part connected to the drive motor and to the second slide means, said rotating part having tab means extending outwardly therefrom;
   iii. sensing means provided along the path of motion of the tab means; and
   iv. arresting means connected to the sensing means and to the drive motor, said arresting means serving to arrest the drive motor for an adjustable length of time as a function of the time lapse between sensed positions of the tab means by the sensing means.

2. The apparatus as defined in claim 1, wherein there are two tabs extending outwardly from the rotating part, said tabs being mutually displaced by 180°, and wherein the sensing means is positioned with respect to the tabs such that the drive motor is arrested at a point in time when the second oscillation has its highest amplitude.

3. The apparatus as defined in claim 1, wherein the arresting means includes a timing relay which turns the drive motor back on after a predetermined and adjustable time.

4. In an apparatus for micro-finish machining of cylindrical or conical surfaces, of total length (D), on rotating workpieces, and in particular the raceways of cylindrical or tapered roller bearings including a honing tool, the improvement comprising:
a. a slide which engages the honing tool;
b. a piston;
c. a connecting rod connecting the piston and the slide;
d. a cylinder within which the piston and connecting rod are reciprocally displaceable, the cylinder and piston defining one chamber and the cylinder, piston and connecting rod defining another chamber;
e. valve means comprising two valves;
f. means connecting each of the two valves to a respective one of the chambers;
g. means connecting the valve means to a source of a pressurized hydraulic medium;
h. a control unit;
i. means connecting the control unit to the valve means; and
j. sensing means associated with both the slide and the control unit, wherein:
   i. displacement of the honing tool relative to the surface to be machined is effected by the slide in response to the reciprocal displacement of the piston;
   ii. the pressurized hydraulic medium passes through each valve to its respective chamber during delivery to and drainage from the respective chamber for effecting the reciprocal displacement of the piston;
   iii. each valve of the valve means is set to control the duration of the delivery time and the drainage time associated with its respective chamber, so that when pressurized hydraulic medium is being admitted to one of the two chambers, pressurized hydraulic medium is being drained from the other of the two chambers;
   iv. the control unit controls the set times or switching times of the two valves so that when the relationship of the switching times is such that the switching times are different the honing tool executes a first oscillatory motion relative to the surface to be machined as a function of the difference, which first oscillatory motion is short as compared with the total length of the surface to be machined; and
   v. the honing tool executes a second oscillatory motion relative to the surface to be machined which is superimposed on the first motion, said second oscillatory motion resulting due to the operative association of the control unit and the sensing means in reversing the relationship of the switching times of the two valves, said second oscillatory motion being determined such that the path of the tool as determined by said motion essentially extends over the total length to be machined.

5. The apparatus as defined in claim 4, wherein the control unit adjusts the switching times to be equal over a predetermined length of time and in terminal positions of the honing tool relative to the width of the surface to be machined, and wherein the terminal positions are sensed by the sensing means so that in cooperation with the control unit a reversal of the second motion can be effected.

* * * * *